United States Patent [19]

Gentischer et al.

[11] Patent Number: 4,597,227

[45] Date of Patent: Jul. 1, 1986

[54] DEVICE FOR ATTACHING A TOOL

[75] Inventors: Josef Gentischer, Weinstadt; Boris Rudolf, Stuttgart, both of Fed. Rep. of Germany

[73] Assignee: C. & E. Fein GmbH & Co., Stuttgart, Fed. Rep. of Germany

[21] Appl. No.: 680,194

[22] Filed: Dec. 10, 1984

[30] Foreign Application Priority Data

| | | | |
|---|---|---|---|
| Feb. 18, 1984 | [DE] | Fed. Rep. of Germany | 3405885 |
| Apr. 14, 1984 | [DE] | Fed. Rep. of Germany | 3414148 |
| Aug. 30, 1984 | [DE] | Fed. Rep. of Germany | 3431901 |

[51] Int. Cl.[4] ..... B24B 23/02

[52] U.S. Cl. ..... 51/168; 83/666

[58] Field of Search ..... 51/168, 170 R, 170 PT, 51/170 T; 83/666, 698; 279/1 K, 8

[56] References Cited

U.S. PATENT DOCUMENTS

| | | | |
|---|---|---|---|
| 870,220 | 11/1907 | Brooks | 83/666 |
| 2,167,744 | 8/1939 | Cosby et al. | 83/666 |
| 2,361,324 | 10/1944 | Severson | 279/1 R |
| 3,244,203 | 4/1966 | Leydig et al. | 83/666 |
| 3,691,900 | 9/1972 | Novak et al. | 51/168 |

FOREIGN PATENT DOCUMENTS

| | | | |
|---|---|---|---|
| 2926469 | 3/1983 | Fed. Rep. of Germany | |
| 609607 | 9/1960 | Italy | 279/8 |

*Primary Examiner*—Roscoe V. Parker
*Attorney, Agent, or Firm*—Max Fogiel

[57] ABSTRACT

A device for attaching a tool in portable angled grinders, allowing the connection to be released without special accessories. The device consists essentially of a hollow driveshaft, of a spindle that slides inside it, and of a tool-securing point consisting of a mating flange and nut. The nut is loosened by activating the displacing mechanism, which displaces the spindle toward the tool-securing point, lifting the nut, which is connected to the spindle by means of a threaded pin, off of the tool. The nut can then be screwed off by hand.

22 Claims, 6 Drawing Figures

DEVICE FOR ATTACHING A TOOL

BACKGROUND OF THE INVENTION

The present invention relates to a device for attaching a tool in portable angled grinders, allowing the connection to be released without special accessories.

In order to replace the grinding disk in known angled grinders, the attaching flange, which is rigidly fastened to the grinding spindle, must be grasped with a special accessory. A mating flange, which is screwed onto the grinding spindle, can then be loosened with another accessory. This procedure is extremely inconvenient, entails the risk of severe injury, and is also very time-consuming.

German Pat. No. 2 926 469 accordingly proposes securing the grinding spindle with a mechanism that is integrated stationary into the drive-mechanism housing. The advantage of that solution is that only one accessory is needed, to loosen the mating flange. Still, the accessory for loosening the mating flange may often be out of reach, and the operator of an angled grinder of this type will be forced to look around for it. Since accessories often get lost, many attempts are made in practice to remove the tool by shear force, damaging the grinder. Furthermore, since the operator of a grinder of this type is not spared the necessity of carrying out a motion relative to the cutting edge of the tool with the hand that is holding the accessory, the risk of injury remains just as high as with the older type of grinder.

Another disadvantage to the tool disclosed in that German patent is the expense incurred in manufacture in order to prevent the grinder from being switched on unintentionally.

SUMMARY OF THE INVENTION

The object of the present invention is to provide a device for attaching a tool to a manually operated angled grinder or similar electric implement in such a way that no accessories are needed to establish or release the connection. The expense incurred in manufacture in order to prevent the grinder from being switched on unintentionally will also be reduced to a minimum.

This object is attained in accordance with the invention in that the angular drive mechanism, which is flanged to the motor of the angled grinder and which consists essentially of a pinion, a beveled cogwheel, and a driveshaft, has a mechanism that can be used to displace a spindle positioned inside the hollow driveshaft toward a securing point for the tool.

The axial displacement of the spindle lifts a nut, which forces the tool against the mating flange, away from the tool. The nut, which is knurled, can then easily be unscrewed from the spindle. No accessory is needed to release the nut in this design. Furthermore, it costs approximately as much to manufacture a displacing device of this type as it does to integrate a spindle-securing device stationary into the drive-mechanism housing. Since the nut is directly hand-held and not screwed on or off with an accessory while the tool is being inserted and extracted, the hand will not come into contact with the cutting edge, reducing the risk of injury.

In brief summary of the preceding description, a device for attaching a tool to an angled grinder is disclosed wherein a displacing mechanism is activated, axially displacing a spindle within a hollow driveshaft. The displacing mechanism is located at one end of the spindle, the other end of which is threaded. The threading accommodates a nut. The nut forces the tool against a mating flange that is rigidly fastened to the driveshaft. The driving motion of the shaft is accordingly transmitted to the tool.

The arrangement described above accordingly allows an essentially simpler procedure for replacing the tools than has previously been possible.

To accelerate and facilitate tool replacement even further, especially when the grinder is to be operated by a robot, the device for attaching the tool to the grinder can also be designed in such a way that the tool can be replaced without turning a nut.

In this embodiment, the threaded fastening is replaced by an insertion fastening. To allow a securing bolt to be inserted into the spindle, a bore with a cross-section that is similar to that of a facing pin on the face of the securing bolt is machined into the face of the spindle. The spindle has, like a drill chuck, slots in the vicinity of the bore to allow the cheeks of this tensioning device to move radially. The radial motion is produced by displacing the spindle axially inside the hollow driveshaft by means of the displacing mechanism and allowing an external conical surface in the slotted area of the spindle to slide over an internal conical surface at a corresponding point on the driveshaft. To attain a reliable positive connection between the pin and the bore, the surface of the pin and the wall of the bore have transverse grooves to allow them to engage when radial pressure is applied to the slotted spindle.

There is a groove with a resilient snap-in structure mounted in it on the surface of the securing bolt to ensure that the bolt has been inserted far enough toward the securing point. The resilient snap-in structure snaps into a matching groove in the hollow driveshaft as soon as it arrives at that point. The securing bolt is designed in such a way that it will rest loosely in the driveshaft when the snap-in point has not been reached, which makes it easy to tell when it must be inserted deeper.

A further embodiment is provided so that, in an angled grinder with a braking device for example, the tool would not automatically come loose subsequent to braking its rotation.

In accordance with the present invention, this embodiment is designed with a bolt screwed into the face of the spindle, which is mounted in such a way that it can be displaced axially inside the hollow driveshaft. The end of the bolt that is remote from the spindle has a flange that forces the tool against the mating flange on the drive shaft through an intermediate bushing, which also has a flange. The bushing has axial teeth along the surface of a cylindrical section. The teeth match other teeth that extend over part of the inside surface of the hollow driveshaft. Between the flange on the bushing and the flange on the bolt, the two surfaces are shaped to provide a positive connection when they engage. The positive connection is not released until the displacing mechanism, through the spindle mounted inside the shaft, lifts the bolt away from the tool and hence the flange on the bolt away from the flange on the bushing. This assumes, of course, that the stroke traveled by the displacing mechanism is longer than the toothed section between the flange on the bushing and on the bolt is deep.

Preferred embodiments of the invention will hereinafter be described with reference to the appended drawings. It is to be understood, however, that these are merely by way of example and that the scope of the protection sought for the invention is defined exclusively in the claims.

DESCRIPTION OF THE PREFERRED EMBODIMENTS

Figure 1:
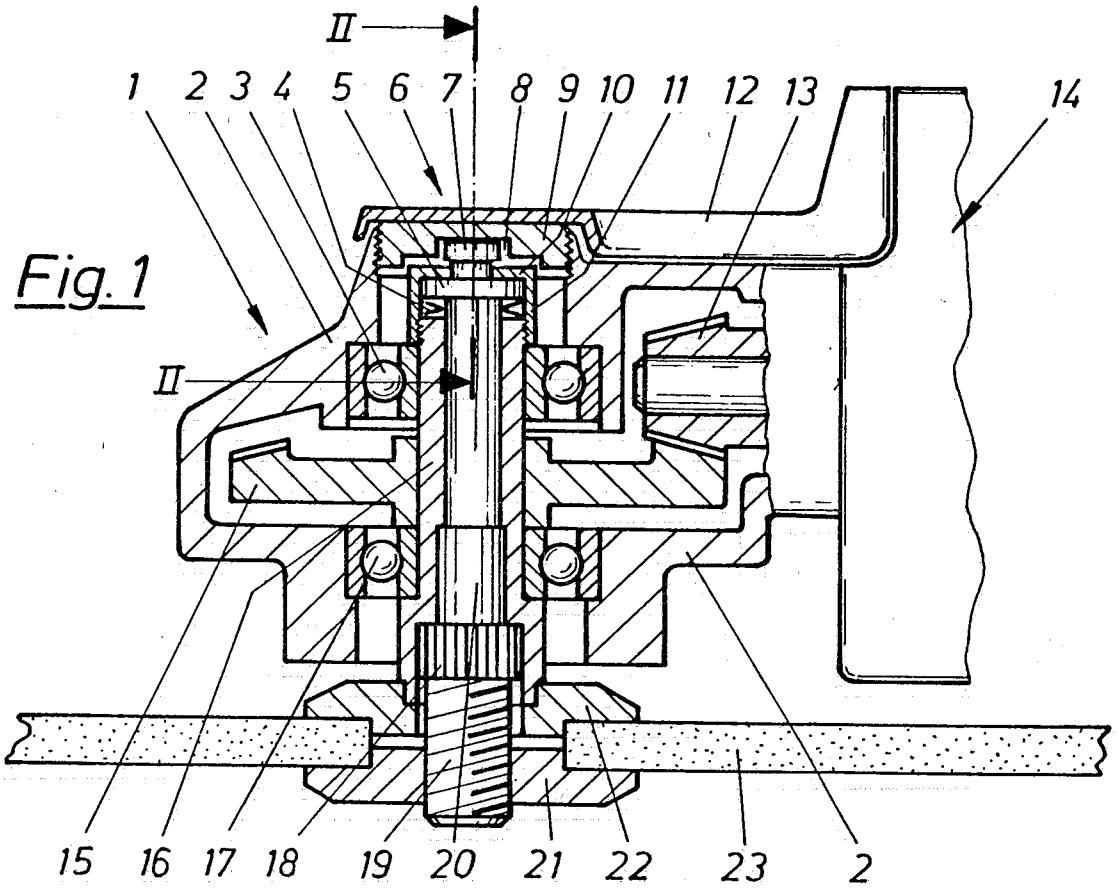
FIG. 1 is a longitudinal section through an angled grinder, with the motor represented only schematically.

The angled grinder illustrated in FIG. 1 consists essentially of a motor 14, represented truncated, of a connected drive mechanism 1, and of a tool 23. The rotation of motor 14 is transmitted through a pinion 13 to a beveled cogwheel 15 that is connected to a driveshaft 16 in such a way that it cannot rotate in relation to the shaft. Driveshaft 16 is mounted in two bearings 3 and 17 in opposite sides of a drive-mechanism housing 2. At one end of driveshaft 16 is a displacing mechanism 6 that can be operated from outside drive-mechanism housing 2. The other end of driveshaft 16 extends far enough out of drive-mechanism housing 2 for a mating flange 22, which secures tool 23, to be rigidly connected to its circumference. Driveshaft 16 is hollow to accommodate a spindle 20. Spindle 20 extends out beyond each face of driveshaft 16. At one end of driveshaft 16 spindle 20 engages with displacing mechanism 6 and at the other end with a threaded pin 19, onto which a nut 21 can be screwed. Mating flange 22 and nut 21 determine a securing point for tool 23. To synchronize driveshaft 16 with spindle 20, the spindle has teeth 18 for example distributed over a certain area and meshing with other teeth inside the driveshaft. This establishes a positive connection, ensuring that spindle 20 will rotate in synchronization with driveshaft 16 while still allowing the spindle to move axially in relation to the shaft.

The axially displacement is produced by displacing mechanism 6. The cylindrical appendage 9 of a lever 12 outside drive-mechanism housing 2 is screwed into drive-mechanism housing 2. The threaded bore in drive-mechanism housing 2 and cylindrical appendage 9 are coaxial with spindle 20. Driveshaft 16, which is mounted in such a way that it can rotate in bearings 3 and 17, has, at the end that projects beyond bearing 3, a bushing-shaped cover 11 with a circular perforation for spindle 20 in its base 10. In the remaining space between the face of driveshaft 16 and the base 10 of bushing-shaped cover 11 is a spring 4 that forces a concentric appendage 5 to spindle 20 against base 10. The terminal component 7 of spindle 20 that extends through the perforation in base 10 projects into a depression 8 in cylindrical appendage 9.

When lever 12 pivots around the axis of cylindrical appendage 9, the appendage is screwed farther into or out of drive-mechanism housing 2. When it is screwed farther in, terminal component 7, and hence spindle 20 as a whole, is displaced axially against the force of spring 4. The axial displacement lifts nut 21 from the lateral surface of tool 23. Since it is no longer necessary to overcome the compression between nut 21 and tool 23 in order to release the nut, the latter, which can be knurled for example, can readily be screwed off of threaded pin 19 manually.

To mount tool 23 it is positioned against mating flange 22 and nut 21 is screwed onto threaded pin 19. How tightly the nut rests against the tool is unimportant. It will tighten on threaded pin 19 automatically once the motor is turned on.

If the operator neglects to pivot lever 12 back into its "closed" position, the facing surfaces of terminal component 7 and of depression 8 are designed so that the friction between them will be sufficient to return the lever to that position when the motor is turned on.

It is also conceivable to employ another type of rotating element, a knob that clicks into "open" and "closed" positions for example, instead of a lever if the pitch of the threading on cylindrical appendage 9 is appropriately selected.

Figure 2:
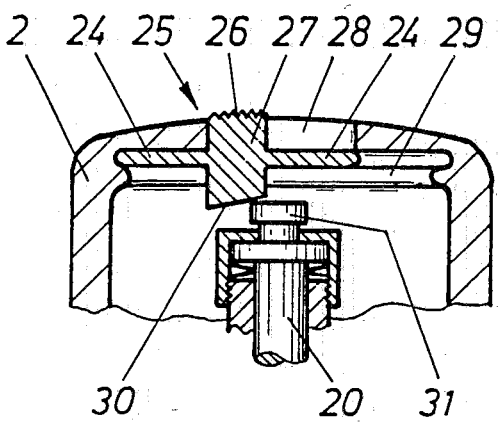
FIG. 2 is a section along the line II—II in FIG. 1 and illustrates a variant.
Figure 3:
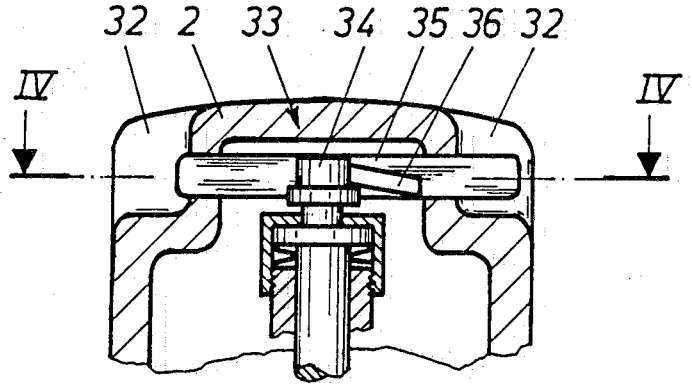
FIG. 3 is in turn a variant of the device illustrated in FIG. 2.
Figure 4:
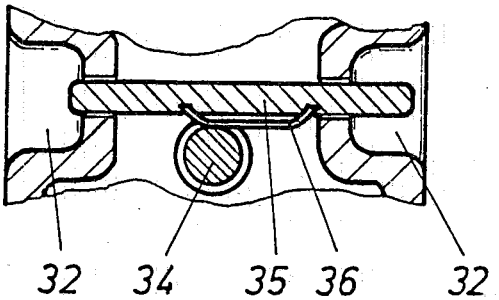
FIG. 4 is a section along the line IV—IV in FIG. 3.

FIGS. 2, 3, and 4 illustrate variants of the displacing mechanism 6 illustrated in FIG. 1 that allow the drive-mechanism housing 2 to be kept smaller.

The spindle 20 in the variant illustrated in FIG. 2 is displaced axially by a displacing mechanism 25. Displacing mechanism 25 has a displacing head 27 that can slide along rails 29 in drive-mechanism housing 2. An access surface 26 on displacing head 27 extends through an aperture 28 and beyond the outer contour of drive-mechanism housing 2. To prevent dust from getting into drive-mechanism housing 2 for instance when displacing head 27 is displaced, the head has two protective strips 24, each of which extends over aperture 28. Displacing head 27 has a sloping surface 30 on the side facing spindle 20. When displacing head 27 is displaced from the "closed" limiting position to the "open" limiting position, sloping surface 30 slides over terminal component 31, forcing spindle 20 toward the tool-securing point.

The displacing mechanism 33 in the variants illustrated in FIGS. 3 and 4 is designed in such a way that it cannot be unintentionally displaced for example when the angled grinder is laid down. There are accordingly troughs 32 in drive-mechanism housing 2 at the transitions between the two lateral surfaces and the side of the housing facing away from tool 23. Troughs 32 have perforations that accommodate a sliding rod 35 that can be moved across the axis of driveshaft 16. Sliding rod 35 travels laterally past a terminal component 34. When sliding rod 35 is displaced, a resilient structure 36 mounted at an angle on it forces a bead on terminal component 34 toward the tool-securing point. Thus, sloping resilient structure 36 produces the same effect as the sloping surface 30 in the variant illustrated in FIG. 2. As will be evident from FIG. 4, terminal component 34 can rotate even when the operator has forgotten to displace sliding rod 35 into the "closed" position before turning on the motor.

The designs described with reference to FIGS. 2, 3, and 4 especially facilitate replacing the tool in the angled grinder. The compact design hardly increases the size of the housing at all. Reliability is increased because the motor can be turned on without any component being blocked inside the housing.

Figure 5:
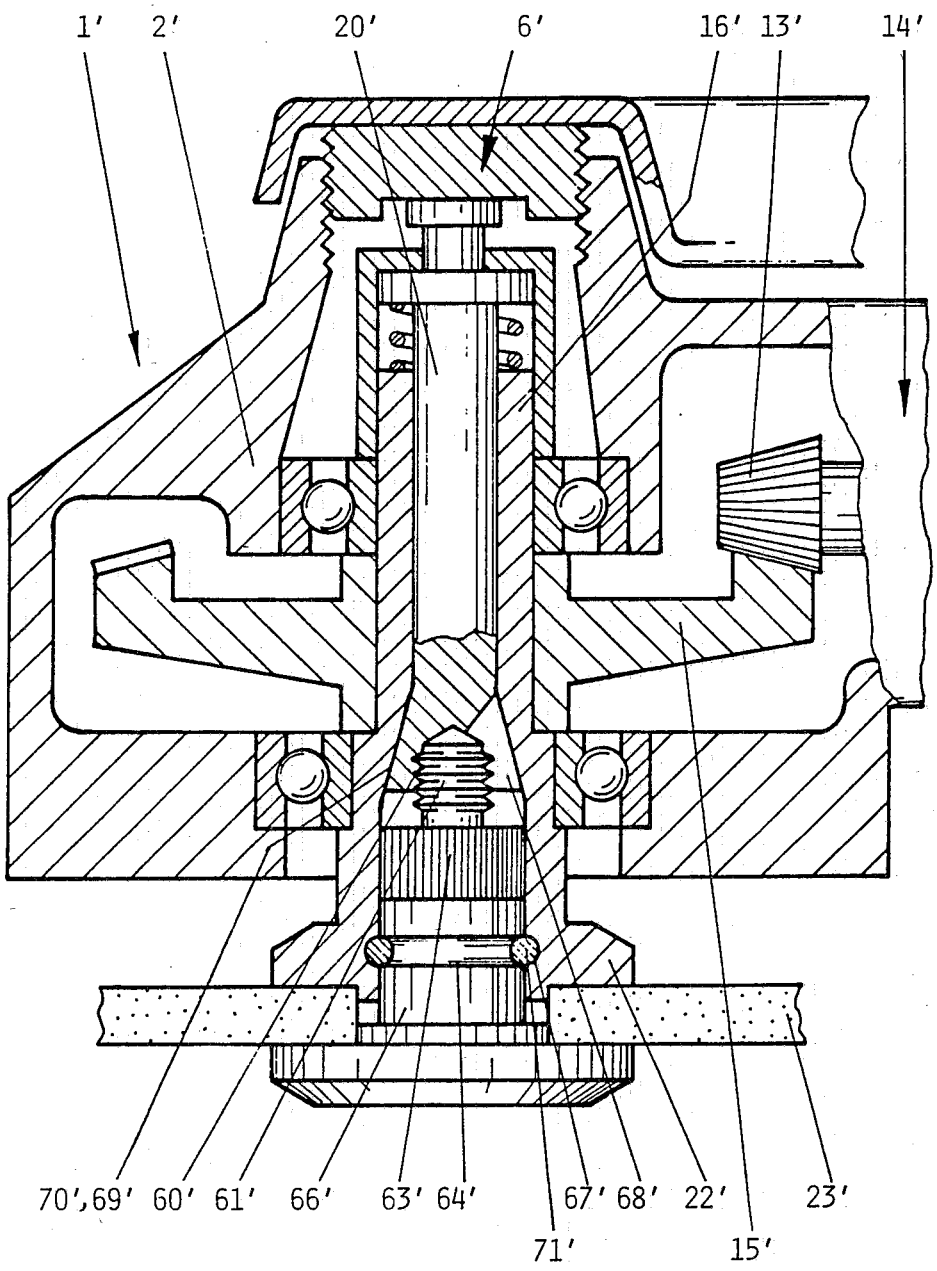
FIG. 5 is a longitudinal section through another embodiment of angled grinder, with the motor represented only schematically.

The angled grinder illustrated in FIG. 5 consists essentially of a motor 14', a drive mechanism 1', and a tool 23. The rotation of motor 14' is transmitted to a beveled cogwheel 15' through a pinion 13'. Beveled cogwheel 13' is mounted on a driveshaft 16' in such a way that it can neither rotate in relation to the shaft nor slide along it. Driveshaft 16' is mounted in two bearings secured in a drive-mechanism housing 2'.

A displacing mechanism 6' can axially displace a spindle 20' positioned inside the hollow driveshaft 16' as described with reference to FIG. 1.

There is a mating flange 22' that extends out of drive-mechanism housing 2' on the end of driveshaft 16' that is remote from displacing mechanism 4'. Tool 23' rests against mating flange 22', whereupon a securing bolt 66' can be inserted through an accommodation aperture in tool 23' into hollow driveshaft 16'. The face of securing bolt 66' has a pin 67' that slips into a matching bore 60' in spindle 20' when securing bolt 66' is inserted in drive-shaft 16'. Spindle 20' has slots 68' in the vicinity of bore 60'. Slots 68' make it possible to force the end of spindle 20' outward radially. This force is generated when securing bolt 66' is inserted in driveshaft 16' and pin 67' slips into bore 60'. Displacing mechanism 6' is then displaced into the "closed" position, moving spindle 20' away from tool'. Pin 67' is then securely clamped into bore 60' in spindle 20' by an external conical surface 69' in the vicinity of slots 68' in spindle 20' and by a matching internal conical surface 70' in driveshaft 16'. To ensure a positive connection, the surface of pin 67' and the wall of bore 60' have transverse grooves. Once pin 11' has been secured, securing bolt 66' as a whole is tensioned toward displacing mechanism 6', securing tool 23'. To prevent relative rotation between drive-shaft 16' and securing bolt 66', both parts have matching teeth 63'.

A resilient snap-in structure 77' is inserted in a groove 64' that surrounds securing bolt 66'. Only when resilient snap-in structure 77' engages a groove 67' in hollow driveshaft 16' has the point been attained at which a positive connection between pin 67' and spindle 20' can be produced. The tolerances between securing bolt 66' and driveshaft 16' have been selected such that the bolt will otherwise lie loosely in the shaft.

Figure 6:
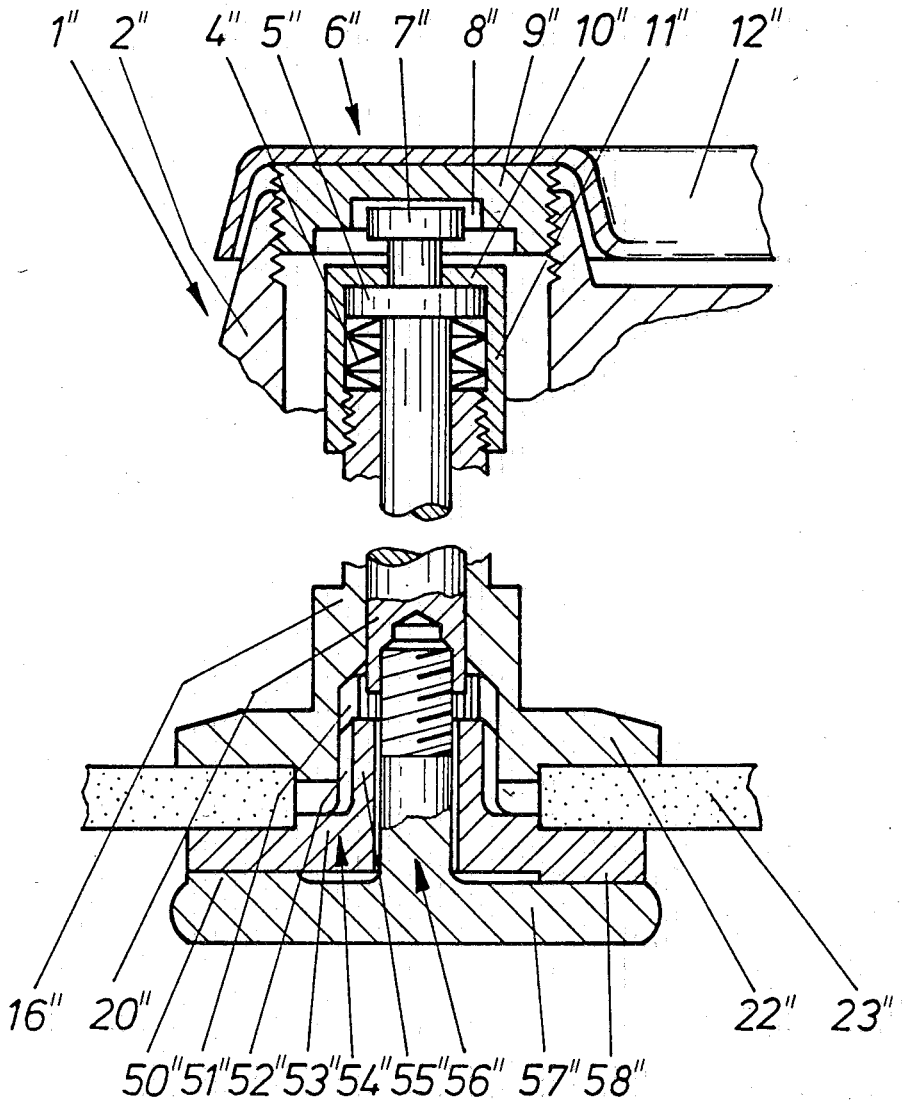
FIG. 6 is a section through the drive-mechanism housing of an angled grinder with known drive-mechanism elements left out.

The gear head 1" illustrated in FIG. 6 has a displacing mechanism 6" that extends on one side out of a drive-mechanism housing 2". Displacing mechanism 6" consists essentially of an activating mechanism 12" and a stroke mechanism 9". Rotating activating mechanism 12" screws stroke mechanism 9", which is rigidly connected to it, axially into or out of a thread in drive-mechanism housing 2" in relation to a driveshaft 16" mounted in the housing. A spindle 20" is mounted in such a way as to be displaced axially inside the hollow driveshaft 16" as described in the foregoing against the force of resilient structures 4" by means of displacing mechanism 6". Driveshaft 16" has at one end a bushing-shaped cover 11" with a circular perforation that accommodates spindle 20" in its base 10". In the remaining space between the face of driveshaft 16" and the base 10" of bushing-shaped cover 11", resilient structures 4" force a concentric appendage 5" to spindle 20" against base 10". The terminal component 7" of spindle 20" that extends through the perforation in base 10" projects into a depression 8" in cylindrical appendage 9". A mating flange 22" is mounted on the end of drive-shaft 16" that is remote from displacing mechanism 6". A tool 23" rests against mating flange 22". An appendage on mating flange 22" centers tool 23". A flange 57" on a bolt 56" indirectly forces tool 23" against mating flange 22" through a flange 53" on a bushing 54". The force is generated when bolt 56" in inserted through the cylindrical section 55" of bushing 54" and its front, which is threaded, screwed into matching threading inside spindle 20", subsequent to which the activating mechanism 12" of displacing mechanism 6" is shifted into the "closed" position. The resulting pressure is sufficient to seat tool 23".

Hollow driveshaft 16" has a wider bore in the vicinity of mating flange 22". The wall of the wider bore has longitudinal grooves 51". Matching teeth 52" in the surface of the cylindrical section 55" of bushing 54" can be inserted in longitudinal grooves 51", ensuring positive transmission of the rotation of driveshaft 16" to bushing 54".

To prevent bolt 56" from twisting out of the thread in spindle 20" when driveshaft 16" is compulsorily braked, flanges 53" and 57" have radial teeth 58" and 50" on their facing surfaces. Teeth 58" and 50" ensure that bolt 56" will rotate along with driveshaft 16" as long as activating mechanism 12" remains in the "closed" position. The collar-like distribution of teeth 58" and 50" on the facing surfaces of flanges 53" and 57" ensures that the contact force can also be absorbed through flange 57".

To ensure that the operator can conveniently screw bolt 56" onto spindle 20" it is recommendable for the edge of flange 57" to be designed such that it can easily be grasped with the hand. This can be done for example by knurling it and/or covering it with a soft and resilient material.

To remove tool 23", activating mechanism 12" must be shifted into the "open" position, whereupon displacing mechanism 6" will displace spindle 20" against the force of resilient structures 4". The stroke will be sufficient to disengage the teeth 50" on the flange 57" on bolt 56" from the teeth 58" on the flange 53" on bushing 54". Bolt 56" can then be screwed out of spindle 20", bushing 54" extracted from driveshaft 16", and tool 23" replaced.

The invention has been described herein with reference to exemplary embodiments. It will be understood, however, that it is receptable of various modifications, which will offer themselves to those skilled in the art and which are intended to be encompassed within the protection sought for the invention as set forth in the appended claims.

We claim:

1. Apparatus for attaching a tool in portable angled grinders comprising a motor; angular drive means, and a securing station for the tool; said angular drive means comprising a pinion, a beveled cogwheel, and a hollow driveshaft having an axis; a spindle positioned in said driveshaft; housing means for housing said drive means; displacing means, said spindle being positioned in said driveshaft so that it cannot rotate but can be displaced axially from outside said housing means by said displacing means; activating means in said displacing means; traveling means and a terminal component, said spindle having an appendage; resilient means between a face of said driveshaft and said appendage on said spindle, said activating means in said displacing means acting through said traveling means at an angle to the axis of said driveshaft on said terminal component against a force of said resilinet means; said driveshaft having a threaded pin; a nut screwed onto said threaded pin; a bushing-shaped cover on said driveshaft for limiting travel so that said nut screwed onto said threaded pin on said driveshaft is lifted away from the tool.

2. Apparatus according to claim 1, wherein said spindle has teeth engaging inside the hollow driveshaft.

3. Apparatus according to claim 1, including a cylindrical appendage on said displacing means; said terminal component being on said spindle; said housing means having a threaded bore; said cylindrical appendage on said displacing means acting on said terminal component to an extent that it is screwed into or out of said threaded bore in said housing means.

4. Apparatus according to claim 1, including a guide in said housing means, said displacing means comprising a displacing head slidable in said guide in said housing means; said displacing head having a sloping surface on a side extending into said housing means.

5. Apparatus according to claim 1, including a sliding rod and troughs with a perforation for accommodating said sliding rod in edges between lateral surfaces and a surface of said housing facing toward the tool; said sliding rod having a spring extending across a direction in which the rod slides in center of a side facing said terminal component.

6. Apparatus according to claim 1, wherein said displacing means can be activated from outside said housing means, said tool being attachable in portable angled grinders with said displacing means that can be activated from outside said housing means; said spindle being positioned in said hollow driveshaft and having tensioning means on an end remote from said displacing means.

7. Apparatus according to claim 6, wherein said spindle has slots forming a drill chuck and an external conical surface in vicinity of said slots.

8. Apparatus according to claim 7, wherein said driveshaft has an internal conical surface in vicinity of said external conical surface.

9. Apparatus according to claim 7, wherein said spindle has a bore of an end of said spindle, said end having said slots.

10. Apparatus according to claim 9, wherein said bore has positive-locking means comprising transverse grooves in a wall of said bore.

11. Apparatus according to claim 6, including a securing bolt connected releasably by said tensioning means to said spindle.

12. Apparatus according to claim 11, wherein said spindle has an end face with a bore having a wall with grooves, said securing bolt having a pin at an end toward said tensioning means, said pin having a surface with positive-locking means comprising transverse grooves engaging the grooves in said wall of said bore.

13. Apparatus according to claim 11, including resilient snap-in means, said securing bolt having around it a groove accommodating said resilient snap-in means.

14. Apparatus according to claim 1, wherein the tool is attachable in portable angled grinders; stroke means; means for mounting said spindle to be displaceable axial but not rotatable in said hollow driveshaft, said spindle being displaceable by said displacing means from outside said housing means, said activating means acting in said housing means through said stroke means transversely to said axis of said driveshaft on said terminal component against a force of said resilient means; a bushing-shaped cover for limiting a stroke and attached to said driveshaft; a bushing with a flange lifted away from the tool, a bolt with a flange screwed into another face of said spindle and positively connected by said flange on said bolt through said flange on said bushing lifted away from the tool and thereby from the flange on said bushing.

15. Apparatus according to claim 1, wherein said bushing has surface with cylindrical section, said cylindrical section having positive-locking means comprising teeth, parallel to an axis of said bushing.

16. Apparatus according to claim 15, including teeth between both said flanges, said teeth having a depth which is less than a stroke of said displacing means.

17. Apparatus according to claim 14, wherein said bolt has means for producing manipulation at an edge of said flange on said bolt.

18. Apparatus according to claim 16, wherein said teeth between said flanges extend over part of a radial expansion.

19. Apparatus according to claim 14, wherein an end of said bolt remote from the flange on said bolt is threaded.

20. Apparatus according to claim 14, wherein said spindle has a face with a threaded bore.

21. Apparatus according to claim 19, wherein said spindle has internal threads; theads on said bolt and the threads in said spindle being long enough for adapting to tools varying in thickness.

22. Apparatus according to claim 14, including appendages on a mating flange, said tool being centered on said appendages on said mating flange and on said flange on said bushing.

* * * * *